US009245410B2

(12) United States Patent
Anderson et al.

(10) Patent No.: US 9,245,410 B2
(45) Date of Patent: Jan. 26, 2016

(54) FUNDING AND REWARDING WAGERING GAME PLAYER ACCOUNTS

(75) Inventors: Peter R. Anderson, Glenview, IL (US); Andrew C. Guinn, Chicago, IL (US); Jeremy M. Hornik, Chicago, IL (US); Travis N. Nelson, Canton, GA (US)

(73) Assignee: Bally Gaming, Inc., Las Vegan, NV (US)

( * ) Notice: Subject to any disclaimer, the term of this patent is extended or adjusted under 35 U.S.C. 154(b) by 183 days.

(21) Appl. No.: 13/546,807

(22) Filed: Jul. 11, 2012

(65) Prior Publication Data

US 2013/0130781 A1 May 23, 2013

Related U.S. Application Data

(60) Provisional application No. 61/506,481, filed on Jul. 11, 2011.

(51) Int. Cl.
*G07F 17/00* (2006.01)
*G07F 17/32* (2006.01)

(52) U.S. Cl.
CPC ..... *G07F 17/3244* (2013.01); *G07F 17/3255* (2013.01)

(58) Field of Classification Search
USPC ..... 463/25
See application file for complete search history.

(56) References Cited

U.S. PATENT DOCUMENTS

| | | | | |
|---|---|---|---|---|
| 6,530,842 | B1 | 3/2003 | Wells et al. | |
| 6,623,357 | B2 | 9/2003 | Chowdhury | |
| 6,729,956 | B2 | 5/2004 | Wolf et al. | |
| 6,932,706 | B1 | 8/2005 | Kaminkow | |
| 7,156,738 | B2 | 1/2007 | Rowe | |
| 7,775,871 | B2 | 8/2010 | Nelson | |
| 2006/0217189 | A1 * | 9/2006 | Walker et al. | 463/25 |

(Continued)

FOREIGN PATENT DOCUMENTS

| | | |
|---|---|---|
| EP | 1380018 | 1/2004 |
| EP | 1399897 | 3/2004 |

(Continued)

OTHER PUBLICATIONS http://web.archive.org/web/20110606054106/https://www.triobet.com/docs?content=poker_signup_1000&ads=false&content_only=false. Created Mar. 15, 2011.*

(Continued)

*Primary Examiner* — Reginald Renwick
(74) *Attorney, Agent, or Firm* — DeLizio Law, PLLC

(57) ABSTRACT

A wagering game system and its operations are described herein. In some embodiments, the operations can include transmitting an offer of a reward to deposit funds into a wagering game player account prior to initiating a wagering game session within a gaming venue, such as a physical gamine venue (e.g., a casino). In one example, the offer is transmitted to a computing device accessible outside the gaming venue. The operations can further include detecting player input associated with the offer, where the player input authorizes a transfer of the funds from a financial account for deposit into the wagering game player account. The operations can further include transferring of the funds specified via the player input from the financial account to the wagering game player account. The operations can further include assigning the reward to the wagering game player account in response to the transferring of the funds.

28 Claims, 8 Drawing Sheets

(56) References Cited

U.S. PATENT DOCUMENTS

| | | | | |
|---|---|---|---|---|
| 2007/0213134 | A1 | 9/2007 | Aida | |
| 2008/0026840 | A1 | 1/2008 | Souza et al. | |
| 2008/0102934 | A1* | 5/2008 | Tan | 463/25 |
| 2008/0146346 | A1* | 6/2008 | Hardy et al. | 463/42 |
| 2009/0176561 | A1* | 7/2009 | Rowe | 463/25 |
| 2010/0184505 | A1 | 7/2010 | Bryson et al. | |
| 2010/0304819 | A1 | 12/2010 | Stockdale et al. | |

FOREIGN PATENT DOCUMENTS

| | | |
|---|---|---|
| EP | 1173261 | 10/2004 |
| EP | 1467807 | 10/2004 |
| EP | 1488388 | 12/2004 |
| EP | 2389649 | 11/2011 |
| EP | 2395487 | 12/2011 |
| WO | WO-0247042 | 6/2002 |
| WO | WO-02069288 | 9/2002 |
| WO | WO-02069289 | 9/2002 |
| WO | WO-03003319 | 1/2003 |
| WO | WO-03061796 | 7/2003 |
| WO | WO-03083794 | 10/2003 |
| WO | WO-2010085285 | 7/2010 |

OTHER PUBLICATIONS http://web.archive.org/web/20110315025632/http://www.triobet.com/eng/docs?content=poker_signup&content_only=false&ads=false. Created Mar. 15, 2011.*

* cited by examiner

FUNDING AND REWARDING WAGERING GAME PLAYER ACCOUNTS

RELATED APPLICATIONS

This application claims the priority benefit of U.S. Provisional Application Ser. No. 61/506,481 filed Jul. 11, 2011.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2012, WMS Gaming, Inc.

TECHNICAL FIELD

Embodiments of the inventive subject matter relate generally to wagering game systems and networks that, more particularly, fund and reward wagering game player accounts.

BACKGROUND

Wagering game machines, such as slot machines, video poker machines and the like, have been a cornerstone of the gaming industry for several years. Traditionally, wagering game machines have been confined to physical buildings, like casinos (e.g., resort casinos, road-side casinos, etc.). The casinos are located in specific geographic locations that are authorized to present wagering games to casino patrons. However, with the proliferation of interest and use of the Internet, shrewd wagering game manufacturers have recognized that a global public network, such as the Internet, can reach to various locations of the world that have been authorized to present wagering games. Any individual with a personal computing device (e.g., a personal computer, a laptop, a personal digital assistant, a cell phone, etc.) can connect to the Internet and play wagering games. Consequently, some wagering game manufacturers have created wagering games that can be processed by personal computing devices and offered via online casino websites ("online casinos"). However, online casinos face challenges and struggles. For instance, online casinos have struggled to provide the excitement and entertainment that a real-world casino environment provides. Some online casinos have struggled enforcing cross jurisdictional restrictions and requirements. Further, some online casinos have struggled adapting the online gaming industry to a traditionally non-wagering game business environment. As a result, wagering game manufacturers, casino operators, and online game providers are constantly in need of innovative concepts that can make the online gaming industry appealing and profitable.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operating environments while the third section describes example operations performed by some embodiments. The fourth section describes additional example operating environments. The fifth section presents some general comments.

INTRODUCTION

This section provides an introduction to some embodiments.

Many wagering game enthusiasts are avid users of the Internet. The Internet and the online content provided via the Internet are expanding and become ever pervasive, and ever useful, in all walks of life. Wagering game providers, therefore, are continuously interested in integrating use of the Internet with use of wagering games.

Some embodiments of the inventive subject matter present examples of providing rewards to a user for funding a wagering game player account, and maintaining funds in the wagering game player account, prior to visiting a gaming venue, such as casino. Some example include providing a website where a user can sign-up for a wagering game player account, then fund the wagering game player account, via the website. Some embodiments include incentivizing the user to deposit funds into the account in return for rewards that can be used online and/or via wagering game machines within a physical gaming venue (e.g., a casino). Some embodiments include rewarding users based on factors related to amounts of funds deposited, cyclical patterns for depositing funds, amount of time that funds remain in the wagering game player account, etc. Other embodiments provide rewards based on performance of online activities, such as based on game play for non-wagering, online games (e.g., performance of casual games associated with a persistent-state wagering game), based on online purchases, based on online social activities, etc.

Figure 1:
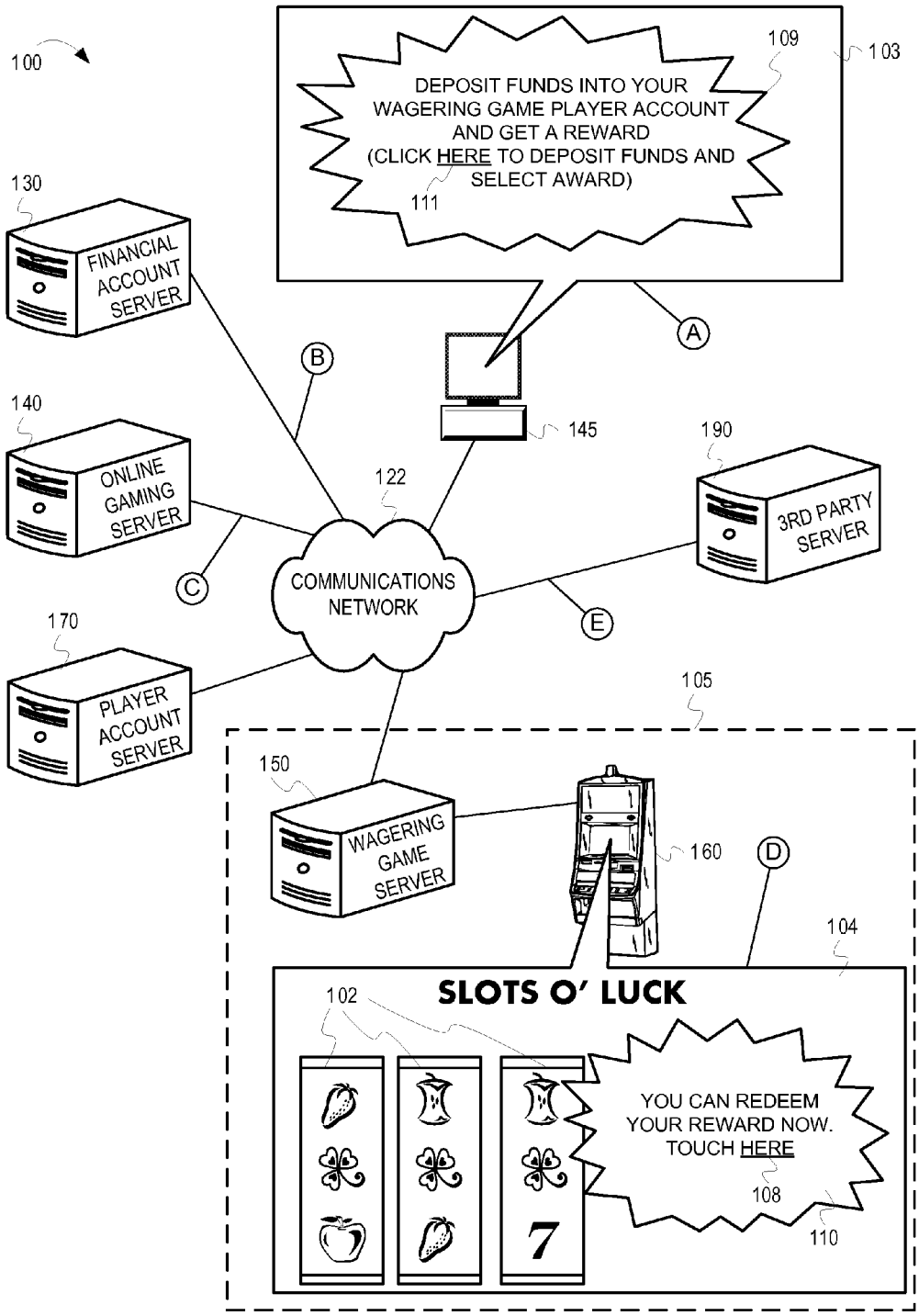
FIG. 1 is an illustration of funding and rewarding a wagering game player account, according to some embodiments.

FIG. 1 is a conceptual diagram that illustrates an example of funding and rewarding a wagering game player account, according to some embodiments. In FIG. 1, a wagering game system ("system") 100 includes an online gaming server 140, a personal computer 145, a player account server 170, a financial account server 130 and a third party server 190 connected via a communications network 122. The system 100 can also include a wagering game server 150 connected to the communications network 122. The wagering game server 150 can serve content to a wagering game machine 160 located within a boundary of a physical gaming venue, such as a casino 105. The boundary of the physical gaming venue can be a geographic boundary, such as the boundary of a casino floor, a casino property, etc. The boundary can further be a wireless boundary, such as a range of wireless transmission of one or more wireless transmitters associated with a geographical location.

At stage "A," the online gaming server 140 provides content 103 (e.g., non-wagering game content, gaming content, secondary content, casual games, etc.) via a website. In some embodiments, the content 103 can be incorporated with a persistent-state game that progresses based on performance in non-wagering, online games as well as with performance in a wagering game. A non-wagering, online game that may be related in theme and function to a wagering game but does not place monetary wagers (e.g., a "for-fun" version of a wagering game, a casual game that emulates gaming functions but uses play funds, etc.). In some embodiments, the online gaming server 140 presents the content 103 via an online browsing session (e.g., via a browser application controlled by the personal computer 145, which browser application presents a webpage that includes the content 103). The content 103 can include a user form, or user interface, to sign up for a wagering game player account, if a user does not already have one. The content 103 can also include a login screen for logging in to an online player account that is linked to the wagering game player account. The online player account can be separate from the wagering game player account, or they can be the same account, yet provide different functions based on whether accessed online as opposed to within a casino. The online player account can provide access to non-wagering content while online (e.g., while outside of a casino), while the wagering game player account can provide access to wagering game content while in a casino. The wagering game player account can be utilized for making wagers on wagering games, such as via the wagering game machine 160 during a wagering game session, within the casino 105. In some embodiments, however, the personal computer 145 can access the wagering game player account via an online gaming venue during an online gaming session, to player wagering games online. The online player account can be linked to the wagering game player account so that information related to the player, to persistent-state games, to account balances, to profile data, etc. can be accessed while in the casino and outside of the casino. Either the online player account and/or the wagering game player account can be stored on and/or tracked by the player account server 170. In this description, the online player account and the wagering game player account may be collectively referred to, occasionally, as a "player account" although, at other times, they may be referred to separately to emphasize a distinction of where the player account is being accessed (e.g., online access may refer to the online player account while in-casino access may refer to the wagering game player account).

While online, after a player logs in to the website using the player account, the online gaming server 140 can customize the content 103 based on settings stored in the player account. During an online browsing session (e.g., while the personal computer 145 accesses the content 103 via a web browser), the content 103 presents a message 109 that offers to reward the player if the player deposits funds into the player account. In some embodiments the message 109 is transmitted to a location outside of a physical gaming venue (e.g., transmitted to an email address, a network address, etc. associated with a server that is not on a casino property or within a casino network—such as to an email account served by an off-site email server). The message 109 may include an object, such as the link 111, which can facilitate the depositing of funds in the player account by selection via user input. For example, the system 100 can detect a selection, via player input, of the link 111, via the content 103, which causes an online form, or similar user interface, to appear via a web browser presented via a display of the personal computer 145. The online form includes fields and/or user controls that can be used to specify an amount to deposit in the player account, as well as financial account information needed to access a financial account hosted by the financial account server 130.

At stage "B," the system 100 can detect the amount specified via the online form and cause an amount of electronic funds to transfer from the financial account server 130 to the player account stored and/or tracked via the player account server 170. The financial account server 130 may be a bank account, a credit card account, a personal funds account (e.g., PayPal™) or any other account that provides electronic amounts of money to player to transfer to the wagering game player account.

At stage "C," the online gaming server 140 detects that the funds were electronically deposited into the player account and assigns a reward to the player account.

At stage "D," the system 100 redeems the reward. For example, a player may log in to the wagering game machine 160 using the player account to initiate a wagering game session. The wagering game server 150 communicates with the player account server 170 to determine that the player account had been previously assigned the reward for deposition of the funds in the player account prior to the player entering the casino 105 and/or prior to initiation of the wagering game session. In some embodiments, the reward is redeemable only during the wagering game session. For instance, the wagering game machine 160 presents wagering game content 104, such as a slot game (e.g., with slot reels 102 and controls and meters that control wagering, track gaming credit balances, etc.). The wagering game content 104 presents a message 110 that includes an object, such as link 108, which is selectable via user input (e.g., via a user touch to a display associated with the wagering game machine 160).

In some embodiments, at stage "E," the system may redeem the reward, or an additional reward, provided via the depositing of the funds in the wagering game player account. For example, the reward may be a third party reward (e.g. a product, service, etc.) awarded via the third party server 190. In some embodiments, the reward may be redeemable via a website hosed by the third party server 190. In other embodiments, the reward may be redeemable via access of the content 103 via the website hosed by the online gaming server 140. The rewards incentivize depositing into the player account prior to the player visiting the casino 105. In some examples, the rewards can be generated, assigned, and redeemed based on various factors, some of which will be described in further detail in connection with FIGS. 3 and 4 below. Many other examples and embodiments are described further below.

Further, some embodiments of the inventive subject matter describe examples of funding, rewarding, and controlling usage of wagering game player accounts in a network wagering venue (e.g., an online casino, a wagering game website, a wagering network, etc.) using a communication network, such as the communications network 122 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, use of the term "player account" can sometimes be used as a substitute for the term "player" as the player account represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
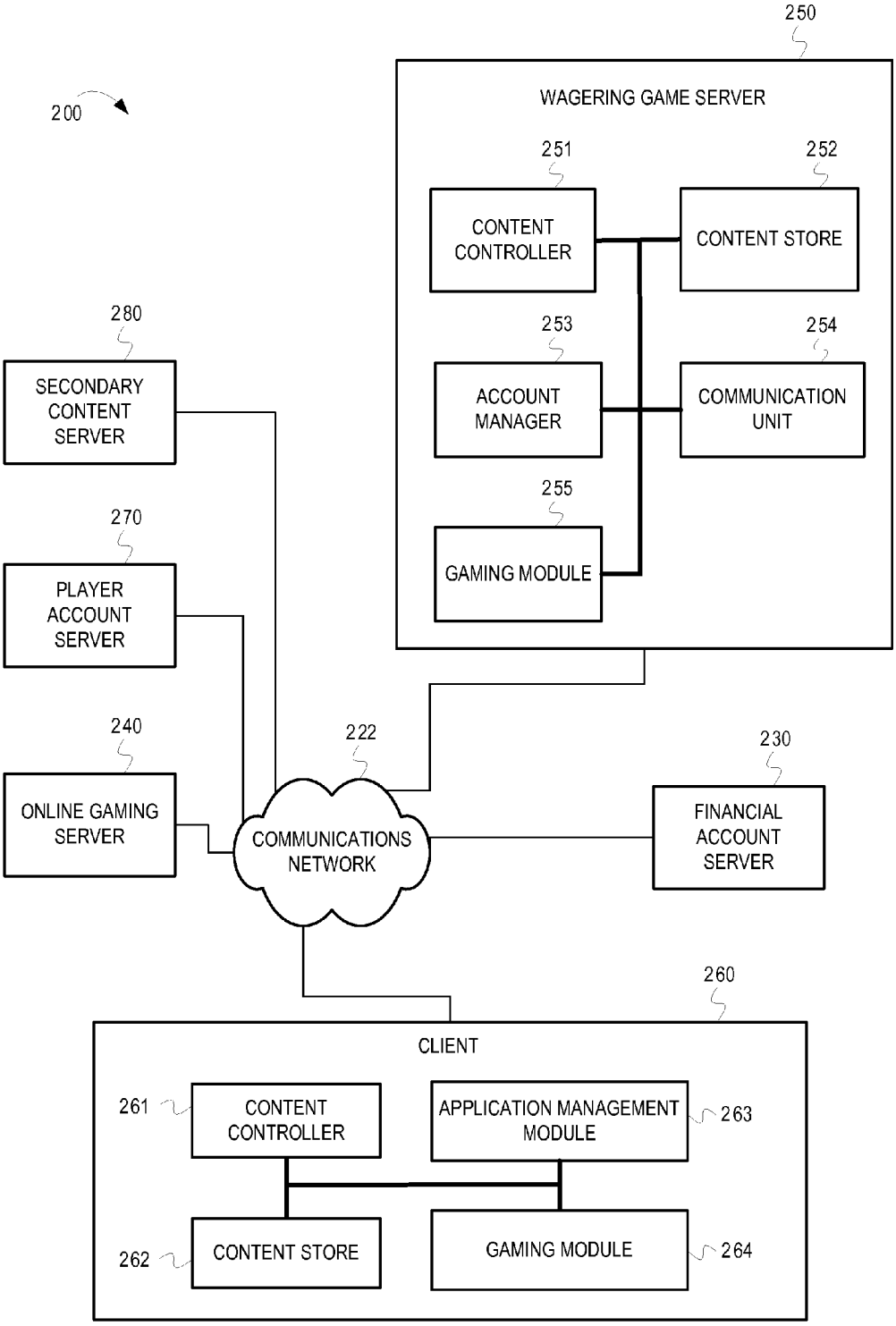
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include a player account server 270 configured to control user related accounts accessible via wagering game networks and social networking networks. The player account server 270 can store wagering game player account information, such as account settings (e.g., settings related to group games, etc., settings related to social contacts, settings related to depositing funds into a wagering game player account, etc.), preferences (e.g., player preferences regarding use of pre deposited funds into a wagering game player account, player preferences regarding use of rewards, player preferences regarding reward types, preferences related to virtual assets, etc.), player profile data (e.g., name, avatar, screen name, etc.), and other information for a player's account (e.g., financial information, account identification numbers, virtual assets, social contact information, etc.). The player account server 270 can contain lists of social contacts referenced by a player account. The player account server 270 can also provide auditing capabilities, according to regulatory rules. The player account server 270 can also track performance of players, machines, and servers.

The wagering game system architecture 200 can also include a wagering game server 250 configured to control wagering game content, provide random numbers, and communicate wagering game information, account information, and other information to and from a client 260. The wagering game server 250 can include a content controller 251 configured to manage and control content for the presentation of content on the client 260. For example, the content controller 251 can generate game results (e.g., win/loss values), including win amounts, for games played on the client 260. The content controller 251 can communicate the game results to the client 260. The content controller 251 can also generate random numbers and provide them to the client 260 so that the client 260 can generate game results. The wagering game server 250 can also include a content store 252 configured to contain content to present on the client 260. The wagering game server 250 can also include an account manager 253 configured to control information related to player accounts. For example, the account manager 253 can communicate wager amounts, game results amounts (e.g., win amounts), bonus game amounts, etc., to the player account server 270. The wagering game server 250 can also include a communication unit 254 configured to communicate information to the client 260 and to communicate with other systems, devices and networks. The wagering game server 250 can also include a gaming module 255 configured to fund, reward, and control usage of player accounts.

The wagering game system architecture 200 can also include the client 260 configured to present wagering games, receive and transmit information related to player accounts, conduct a gaming session, present non-wagering-game content, control persistent-state games, provide episodic content, etc. The client 260 can, in some embodiments, be a computer system, a personal digital assistant (PDA), a cell phone, a laptop, a wagering game machine, or any other device or machine that is capable of processing information, instructions, or other data provided via the communications network 222. The client 260 can include a content controller 261 configured to manage and control content and presentation of content on the client 260. The client 260 can also include a content store 262 configured to contain content to present on the client 260. The client 260 can also include an application management module 263 configured to manage multiple instances of gaming applications. For example, the application management module 263 can be configured to launch, load, unload and control applications and instances of applications. The application management module 263 can launch different software players (e.g., a Microsoft® Silverlight™ player, an Adobe® Flash® player, etc.) and manage, coordinate, and prioritize what the software players do. The application management module 263 can also coordinate instances of server applications in addition to local copies of applications. The application management module 263 can control window locations on a wagering game screen or display for the multiple gaming applications. In some embodiments, the application management module 263 can manage window locations on multiple displays including displays on devices associated with and/or external to the client 260 (e.g., a top display and a bottom display on the client 260, a peripheral device connected to the client 260, a mobile device connected to the client 260, etc.). The application management module 263 can manage priority or precedence of client applications that compete for the same display area. For instance, the application management module 263 can determine each client application's precedence. The precedence may be static (i.e. set only when the client application first launches or connects) or dynamic. The applications may provide precedence values to the application management module 263, which the application management module 263 can use to establish order and priority. The precedence, or priority, values can be related to tilt events, administrative events, primary game events (e.g., hierarchical, levels, etc.), secondary game events, local bonus game events, advertising events, etc. As each client application runs, it can also inform the application management module 263 of its current presentation state. The applications may provide presentation state values to the application management module 263, which the application management module 263 can use to evaluate and assess priority. Examples of presentation states may include celebration states (e.g., indicates that client application is currently running a win celebration), playing states (e.g., indicates that the client application is currently playing), game starting states (e.g., indicates that the client application is showing an invitation or indication that a game is about to start), status update states (e.g., indicates that the client application is not 'playing' but has a change of status that should be annunciated, such as a change in progressive meter values or a change in a bonus game multiplier), idle states (e.g., indicates that the client application is idle), etc. In some embodiments, the application management module 263 can be pre-configurable. The system can provide controls and interfaces for operators to control screen layouts and other presentation features for the configuring of the application management module 263. The application management module 263 can communicate with, and/or be a communication mechanism for, a base game stored on a wagering game machine. For example, the application management module 263 can communicate events from the base game such as the base game state, pay line status, bet amount status, etc. The application management module 263 can also provide events that assist and/or restrict the base game, such as providing bet amounts from secondary gaming applications, inhibiting play based on gaming event priority, etc. The application management module 263 can also communicate some (or all) financial information between the base game and other applications including amounts wagered, amounts won, base game outcomes, etc. The application management module 263 can also communicate pay table information such as possible outcomes, bonus frequency, etc. In some embodiments, the application management module 263 can control different types of applications. For example, the application management module 263 can perform rendering operations for presenting applications of varying platforms, formats, environments, programming languages, etc. For example, the application management module 263 can be written in one programming language format (e.g., Javascript, Java, C++, etc.) but can manage, and communicate data from, applications that are written in other programming languages or that communicate in different data formats (e.g., Adobe® Flash®, Microsoft® Silverlight™, Adobe® Air™, hyper-text markup language, etc.). The application management module 263 can include a portable virtual machine capable of generating and executing code for the varying platforms, formats, environments, programming languages, etc. The application management module 263 can enable many-to-many messaging distribution and can enable the multiple applications to communicate with each other in a cross-manufacturer environment at the client application level. For example, multiple gaming applications on a wagering game machine may need to coordinate many different types of gaming and casino services events (e.g., financial or account access to run spins on the base game and/or run side bets, transacting drink orders, tracking player history and player loyalty points, etc.).

The client 260 can also include a gaming module 264 configured to fund, reward, and control usage of player accounts.

The wagering game system architecture 200 can also include a secondary content server 280 configured to provide content and control information for secondary games and other secondary content available on a wagering game network (e.g., secondary wagering game content, promotions content, advertising content, player tracking content, web content, etc.). The secondary content server 280 can provide "secondary" content, or content for "secondary" games presented on the client 260. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 280 can provide and control content for community games, including networked games, social games, competitive games, or any other game that multiple players can participate in at the same time. In some embodiments, the secondary content server 280 can control and present an online website that hosts wagering games. The secondary content server 280 can also be configured to present multiple wagering game applications on the client 260 via a wagering game website, or other gaming-type venue accessible via the Internet. The secondary content server 280 can host an online wagering website and/or a social networking website. The secondary content server 280 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The secondary content server 280 can also be configured to fund, reward, and control usage of wagering game player accounts. In some embodiments, the secondary content server 280 can also host social networking accounts, provide social networking content, control social networking communications, store associated social contacts, etc. The secondary content server 280 can also provide chat functionality for a social networking website, a chat application, or any other social networking communications mechanism. In some embodiments, the secondary content server 280 can utilize player data to determine marketing promotions that may be of interest to a player account. The secondary content server 280 can also analyze player data and generate analytics for players, group players into demographics, integrate with third party marketing services and devices, etc. The secondary content server 280 can also provide player data to third parties that can use the player data for marketing. In some embodiments, the secondary content server 280 can provide one or more social networking communication mechanisms that publish (e.g., post, broadcast, etc.) a message to a mass (e.g., to multiple people, users, social contacts, accounts, etc.). The social networking communication mechanism can publish the message to the mass simultaneously. Examples of the published message may include, but not be limited to, a blog post, a mass message post, a news feed post, a profile status update, a mass chat feed, a mass text message broadcast, a video blog, a forum post, etc. Multiple users and/or accounts can access the published message and/or receive automated notifications of the published message.

The wagering game system architecture 200 can also include a online gaming server 240 configured to control and present an online website that hosts gaming related content (e.g., wagering games, non-wagering games that share common themes to wagering games, social networking content related to gaming, etc.). The online gaming server 240 can also be configured to present multiple wagering game applications via the client 260 (e.g., via a browser application or widget installed on the client 260). The online gaming server 240 can be configured to present content via a wagering game website, or other gaming-type venue accessible via the Internet. The online gaming server 240 can also host a social networking website or social network. The online gaming server 240 can include mechanisms that provide functionality (e.g., controls, web pages, applications, etc.) that web users can use to connect to a social networking application and/or website and utilize social networking and website features (e.g., communications mechanisms, applications, etc.). The online gaming system 240 can also be configured to provide and control mobile content and communications, such as email, text messages, instant messages, mobile applications, etc. The online gaming system 240 can utilize GSM (Global System for Mobile communications) protocols, the Short Message Service (SMS), or other communication standards associated with mobile communications, text messaging, email, instant messaging, mobile applications, etc.

The wagering game system architecture 200 can also include a financial account server 230 configured to host a financial account assigned to a user. The financial account can include credit accounts (e.g., credit card accounts, Internet credit accounts, bank lines of credit, casino lines of credit, etc.), bank accounts, savings accounts, and other financial accounts. The financial account can include account holder information (e.g., name, address, etc.), account numbers, personal identification numbers (PINs), account access numbers, passwords, etc. The financial account can be linked to other accounts, such as online gaming accounts, wagering game player accounts, etc.

Each component shown in the wagering game system architecture 200 is shown as a separate and distinct element connected via a communications network 222. However, some functions performed by one component could be performed by other components. For example, the wagering game server 250 can also be configured to perform functions of the application management module 263, the gaming module 264, and other network elements and/or system devices. Furthermore, the components shown may all be contained in one device, but some, or all, may be included in, or performed by, multiple devices, as in the configurations shown in FIG. 2 or other configurations not shown. For example, the account manager 253 and the communication unit 254 can be included in the client 260 instead of, or in addition to, being a part of the wagering game server 250. Further, in some embodiments, the client 260 can determine wagering game outcomes, generate random numbers, etc. instead of, or in addition to, the wagering game server 250.

As mentioned previously, in some embodiments, the client 260 can take the form of a wagering game machine. Examples of wagering game machines can include floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, clients and wagering game servers work together such that clients can be operated as thin, thick, or intermediate clients. For example, one or more elements of game play may be controlled by the client or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the clients can present a graphical representation of such outcome or asset modification to the user (e.g., player). In a thick-client example, the clients can determine game outcomes and communicate the outcomes to the wagering game server for recording or managing a player's account.

In some embodiments, either the client or the wagering game server(s) can provide functionality that is not directly related to game play. For example, account transactions and account rules may be managed centrally (e.g., by the wagering game server(s)) or locally (e.g., by the client). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
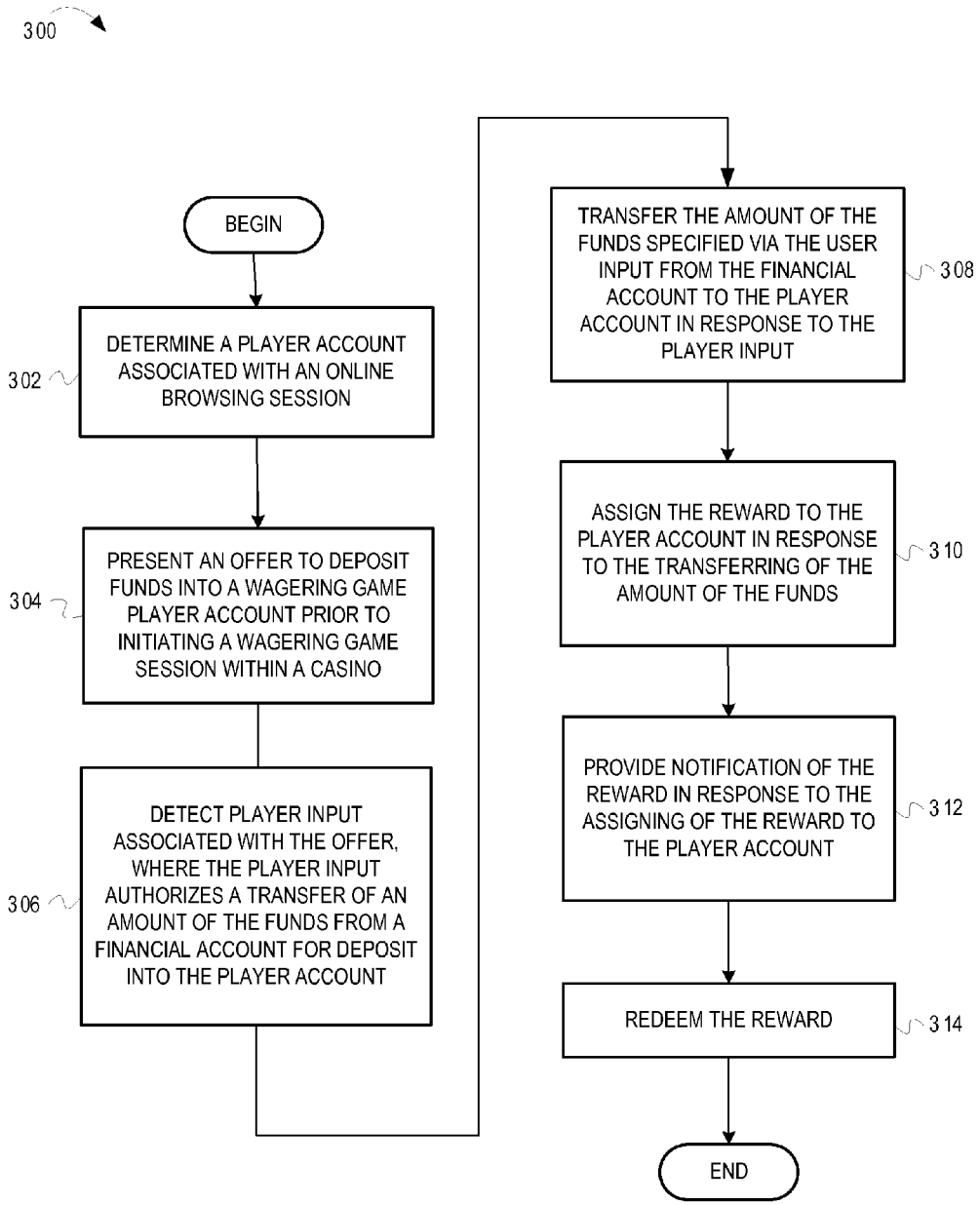
FIG. 3 is a flow diagram 300 illustrating funding and rewarding a wagering game player account, according to some embodiments.
Figure 4:
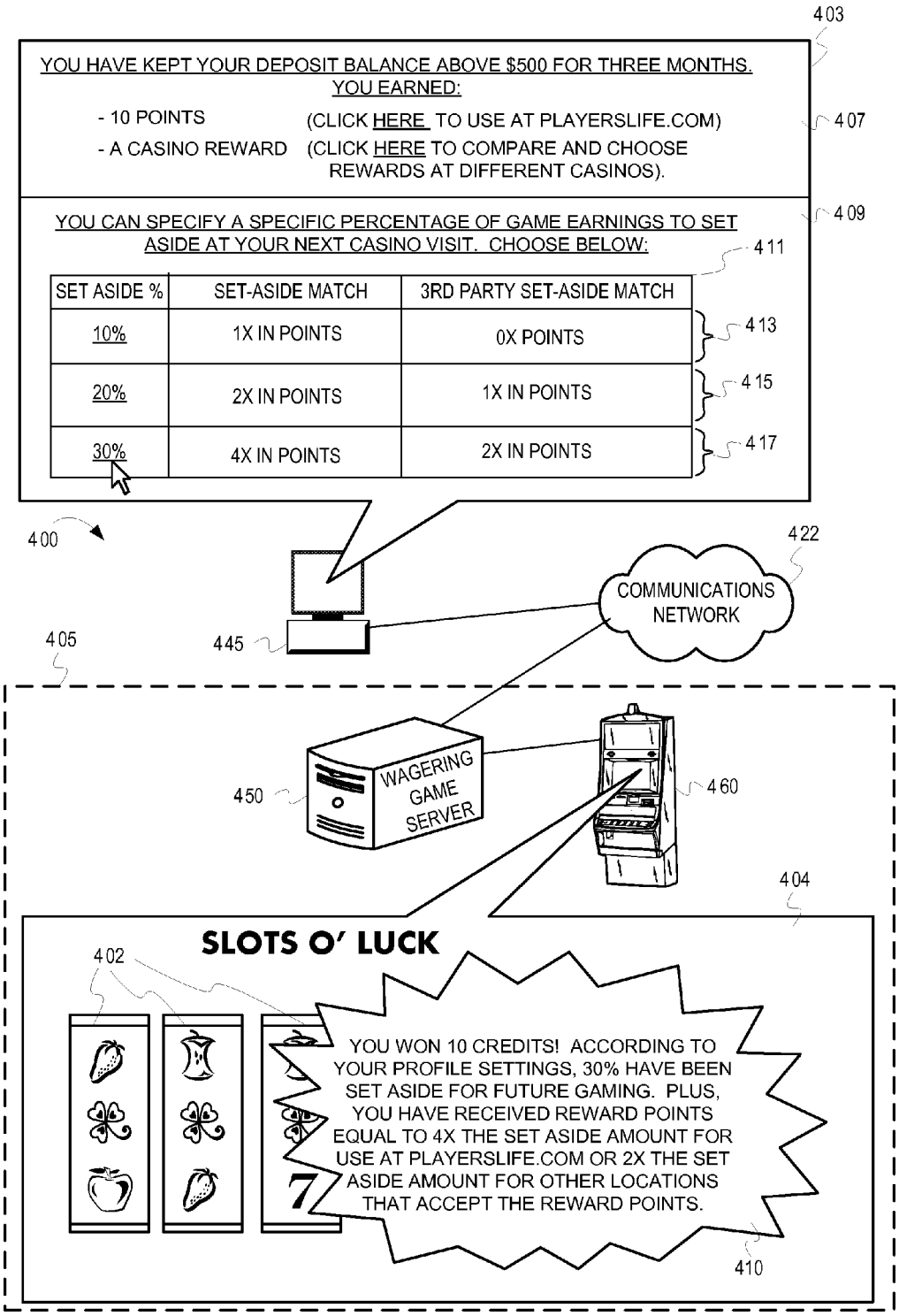
FIG. 4 is an illustration of funding and rewarding a wagering game player account, according to some embodiments.

FIG. 3 is a flow diagram ("flow") 300 illustrating funding and rewarding a player account, according to some embodiments. FIGS. 1 and 4 are conceptual diagrams that help illustrate the flow of FIG. 3, according to some embodiments. This description will present FIG. 3 in concert with FIGS. 1 and 4. In FIG. 3, the flow 300 begins at processing block 302, where a wagering game system ("system") determines a player account associated with an online browsing session. For example, the online browsing session presents a website that a player can utilize to generate a new player account in response to user input via the website. The website can also provide a login interface that a player utilizes to login via the website and initiate an online gaming session that provides non-wagering-game content and/or wagering game content. The system can track activity performed via the browsing session.

The flow 300 continues at processing block 304, where the system presents an offer to deposit funds into a player account prior to initiating a wagering game session within a casino. For example, the system can transmit a message that offers the reward. The message is configured for receipt via a computing device accessible outside a casino. For example, the message may be presented via email, a webpage, a text message, etc. In some embodiments the message is directed to an identifier associated with the player account. For example, the system can direct the message to an email address, an IP address associated with the computing device, a mobile telephone number assigned to the computing device, a web page accessed during an online browsing session via the computing device, a contact identifier associated with a financial account linked to the player account, etc. In some embodiments the message includes an object configured for response (e.g., by selection) via user input. For example, the object can be a link that can be selected (e.g., activated), a button that can be selected (e.g., pressed), a string of text that can be selected (e.g., copied and pasted into a URL field), etc.

The flow 300 continues at processing block 306, where the system detects player input associated with the offer, where the player input authorizes a transfer of an amount of the funds from a financial account for deposit into the player account. In some embodiments player input is associated with use of the object included in the message (e.g., the player input activates the object, manipulates the object, modifies the object, etc.). In some embodiments player input specifies the amount of funds and includes authorization information (e.g., passwords, codes, personal identification numbers, answers to security questions, unique player-specific biometric data, etc.) and other account information to connect the financial account to the player account.

The flow 300 continues at processing block 308, where the system transfers the amount of the funds specified via the user input from the financial account to the player account in response to the player input. The system can authorize the transfer, conduct one or more transfer transactions associated with the transfer of the funds, etc. The funds transfer can occur via the Internet, or other public and private networks, using secure transfer protocols.

The flow 300 continues at processing block 310, where the system assigns the reward to the player account in response to the transferring of the amount of the funds. For example, the system can assign the reward to the player account for use during a wagering game session, during an online browsing session, offline, via a mobile client, or in other ways. In some embodiments, the system transmits a coded identifier to redeem the reward, such as a keycode, a barcode, a matrix code, a Quick Response code, etc. The coded identifier includes attributes that can link back to the player account when scanned.

In some embodiments, the reward types include rewards redeemable directly online. For example, the reward can be "for fun" funds, or non-monetary credits, to play a non-wagering, online game on a website or access to unique online content that a user would normally not have access to. In another example, the reward can be to unlock chapters to adaptive games online that are persistent and/or episodic. In yet another example, the reward can be to make a player account eligible to trigger an online progressive award. In another example, the reward can be a sweepstakes entry or a third-party service, product, or discount. In another example, the reward can be points, a free mobile application, and entry into a non-wagering, online community game, etc.

In some embodiments, the rewards are redeemable online rewards that also contribute to in-casino rewards. For instance, the system can provide a reward that is redeemable online (e.g., via a website), and that can also contribute to additional rewards redeemable in a casino based on some condition or aspect related to the redemption of the online reward, such as performance, achievement, progress etc. in an online game, a balance of a player account at the time of redemption, etc. The reward can be based on an average balance, minimum balance, etc. of the player account during the interaction with the online game. In another example, if a player attains a certain game achievement in an online game, and if the player's account balance is at a certain threshold when the game achievement is attained, then the system can increase a value to the reward, or select a reward that is more significant in value based on the value of the account balance. In some embodiments, the system can cause an online gaming achievement to become a goal or objective to attain while in the casino and, if attained in the casino will pay out the reward. For instance, if a player attains a full-house in an online game, then the full-house has meaning when played in the casino and, if attained in the casino, will provide a monetary reward (e.g., full houses would then pay 15% more). A performance in an online game can unlock types of functionality or features (e.g., bets types) available in a wagering game. The online game activity can further cause an increase to a value of a potential win or expected value (EV) in a wagering game or bonus game. The online game activity can further adjust a rate of change of mile/progression markers in a persistent-state game (e.g., double miles), which advance more quickly to unlock gaming content. Further, a non-wagering, online game can provide incremental rewards that increase in value the more a user plays the non-wagering, online game.

In some embodiments, the system provides rewards that are redeemable directly in-casino. For example, when a player deposits funds online, the system can assign the reward and store the reward until the player activates a wagering game session in a casino via the player account, until the player logs in to a device in a casino that uses the player account (e.g., a kiosk, an electronic gaming table, a wagering game machine, a player check-in station, a casino bank, a hotel lobby check-in station, etc.). The system can then make the reward available at the casino. Some examples of rewards available exclusively at a casino, or other physical gaming venue, include, but are not limited to: unlocking or providing unique in-casino content; providing access to restricted secondary games that normally would not be available; providing a bonus in a wagering game; increasing a win value or potential win value (e.g., increase maximum payout, expected value, etc. in a wagering game); providing tickets for shows, buffets, or other services and items available at a casino; providing access to restricted, up-and coming primary wagering games that are not yet available to the general public; providing virtual assets that represent achievements for persistent-state games and/or that improve performance in wagering games; providing social status points; customizing features of wagering game content; changing a configuration of game play elements in wagering game content; changing a character presented via wagering game content; modifying a theme of wagering game content; etc. Another example of a reward available in a casino includes a hot tip, or a secret tied to an activity. For instance, the hot tip can be a direction to perform an activity as in a scavenger hunt, where the direction is to find a particular location or device within a casino and perform a specific activity at the location or device. As a result of the performance of the specific activity, the system can then provide an award. For example, the hot tip may indicate a direction to find a wagering game machine with a specific theme (e.g., the "Zeus" game) at a specific location (e.g., nearest to a particular restaurant). The activity may be to login to that wagering game machine. If the wagering game machine is not available, then the system could provide a message that will notify the player (e.g., via a mobile device) which machine to go to next. The system can instead place the player on a wait-list for the wagering game machine and notify the player when the wagering game machine becomes available. In another example, the activity may be to order a food item from the restaurant, such as via a food ordering application on the wagering game machine.

In some embodiments, one or more characteristics (e.g., an amount, a type, a subject matter, etc.) of the reward is related in degree of value to a condition (e.g., an aspect, attribute, event, characteristic, etc.) associated with online activity outside of the casino. The following paragraphs indicate a few examples of conditions associated with online activity, which may affect a characteristic of the reward.

Deposit Based Factors.

The degree of the reward can be based on a condition that occurs in connection with the deposit, such as activity performed in parallel with the deposit while in the online browsing session, prior to the deposit, in response to the deposit, in connection with a balance for the wagering game at the time of the deposit, etc. For example, the system can set an amount of a reward to be proportional, or equivalent, to an amount of funds deposited (e.g., provide as a reward an amount of "for-fun" funds, or credits used to play non-wagering, online games on a website, that matches or is proportional to an amount of money deposited into the player account). In some examples, a threshold or scale of reward values can coincide with a scale of an amount of the deposit (e.g., amount of reward is relatively greater for larger amounts deposited). For example, higher levels or degrees of deposit amounts can provide increasingly larger levels or degrees of rewards (e.g., a $100 deposit may reward 100 points, but a $200 deposit may reward 300 points, wherein the scale of reward increases in factor or percentage the higher the deposit amount increases).

Performance Based Factors.

A degree of the reward can be based on a degree of achievement or a degree of performance in a contest or challenge associated with online content. For example, the reward can increase in value based on performance in a non-wagering-game played online.

Time Based Factors.

A degree of the reward can be based on a degree of time or on some other time based value. For example, in some examples the system can increase rewards based on a degree of time in advance that a player deposits money into the player account before using the funds during a wagering game session. For instance, the system can reward a greater degree of non-wagering, or "for-fun" type of credits, for use with non-wagering games and other online content, proportional to larger amounts of time, in advance, a player deposits the money before visiting a casino and/or using the funds on a wagering game session. In some embodiments, cyclical deposits can result in greater rewards (e.g., automatic extractions of money from a weekly paycheck, for example, for deposit into the player account). In some embodiments, rewards can expire (e.g., a time to redeem rewards can expire if a player does not deposit or used funds within a specific number of days or time periods the player may lose all or part of a previously awarded reward). In some embodiments, the longer a player maintains a previously deposited amount of money in the player account, then the greater rewards the system will offer. For example, for each week that a player maintains the balance of the player account above a certain level, then the player will receive a free spin. The reward can increase over time. For instance, for each week the player account balance remains above the certain level, then the system rewards higher rewards (e.g., at the respective ends of weeks one through four, the player receives one additional spin, but at the end of the fifth week the player receives two additional spins instead of one additional spin and so forth, while and at the end of the tenth week, the player receives three additional spins instead of only one or additional spins per week, etc.). In another example, the longer the balance remains above the certain level, points in a player account may increase automatically in value. The system can also modify reward values based on average balances over time instead of, or in addition to, checking balances at specific intervals. Thus, a player can wager and replenish without worrying about the amount falling below threshold level at a given moment. In some embodiments, when a player enters a casino, the system can check the balance of the account and determine the value of the reward at that time based on the amount in the player account.

Purchase Based Factors.

In some examples, a reward value can be based on a value of an online purchase. For instance, a player may purchase a product or service from an online retailer (e-tailer) and be given an option to deposit funds into the player account in connection with the purchase, in return for a reward. The value of the purchase and/or the value of the deposit can be used to determine a value for the reward. For example, the system can offer travel bundles that include rewards. The system can provide rewards (e.g., points, credits, etc.) that a third-party can bundle with a travel package or deal. More specifically, in one example, when a player purchases airfare and hotel for the package, the system also can make a direct deposit into the player account (e.g., from a credit card used to purchase the travel package). The system can reward the direct deposit of funds and base the reward on the amount of money spent on the travel package and/or on the amount deposited.

Third-Party Affiliation Factors.

The system can offer rewards for an affiliate type deal. For example, if a player books a flight to Las Vegas using an online third-party travel agent, then the third party provides a portion of reward and/or a casino provides payment to the third party for offering the reward. The casino and third party can have a collaborative agreement on how to apportion and/or reimburse the reward. In some embodiments, a credit card company can offer a credit card that offers rewards for spending, using the credit card, in return for rewards. For instance, each amount of money spent on purchases using the credit card may deposit a percentage of money into the player account (e.g., an additional amount of money equivalent to 0.025% of the money spent on the credit card purchase gets automatically deposited into the player account) and a matching reward value can be based on the percentage of money deposited (e.g., a matching reward of points are awarded based on the of 0.025% value). The system can offer options for the player to increase or decrease the percentage. In some embodiments, the reward values can increase based on a type of the purchase. For instance, greater rewards can be available for pre-specified types that relate to wagering (e.g., purchases made on the credit card for merchandise or services associated with a sports team that a player can later wager on in a wagering game or in a casino).

Social Contact Affiliation Factors.

The system can offer rewards whose values are based on affiliation with social contacts (e.g., friends, family, etc.). In some embodiments the system can reward a player rewards for encouraging or recruiting friends to deposit money into their own player accounts or into the player's player account. The system can incentivize the friends by offering the same value of reward offered to the player in connection with their deposit (e.g., a player deposits a large value resulting in a large reward and the system offers to reward all friends of the player with the same large reward if the friends deposit more than 25% of the amount deposited by the player). In some examples, the system can reward a player based on a number of friends recruited, an overall amount of deposited made in response to recruiting efforts (e.g. in response to direct invitations), etc. The invitations can include objects that specify the affiliated relationship between the player and the recruited friend and that offer direct depositing options (e.g., a link in the invitation permits the friend to make a direct electronic deposit into a player account and, via the use of the link, the system attributes the friend's deposit to the player). In some embodiments, the system can award a specific percentage of rewards awarded to social contacts back to the player based on the player's recruitment efforts. In some examples, the number of invitations can be limited but increasable via additional activity (e.g., the system only allows the player to make a limited amount of invitations, but, via play of non-wagering, online games the player can increase, or replenish, the number of invitations that the player is allowed to send). In some embodiments, the system can permit a player to recruit friends to deposit money into the player's player account with instructions on how to wager on behalf of friends. Any achievement (e.g., wins, virtual assets, points, etc.) attained in the casino, by the player, can provide additional rewards for online use which can be apportioned to the friends according to an amount of the friend's funds used for the wagering activity. In some embodiments, the system enables players to share rewards with social contacts in order to get a higher reward. For example, a player receives as a reward access to a non-wagering, online game because the player deposited money. The player then invites friends to play the non-wagering, online game (e.g., via email invitation, text invitation, etc.). Based on a degree of access to the non-wagering, online game (e.g., based on a number of friends that access the non-wagering, online game, based on a degree of progress made in the non-wagering, online game by the friends, etc.), the system can increase a reward factor for the player. The system can then offer additional rewards to the player for the access to the non-wagering, online game by the friends, such as rewards that are redeemable in a casino. The system can track the use of the in-casino rewards by the player and based on a use of the in-casino reward, provide additional rewards back to the friends that previously accessed the non-wagering, online game.

Returning to FIG. 3, the flow 300 continues at processing block 312, where the system provides notification of the reward in response to the assigning of the reward to the player account. In some embodiments, the system transmits the message (e.g., an email, a text message, a webpage pop-up, etc.) to an identifier associated with contact information (e.g., to an email address, to a mobile phone number, to an Internet Protocol (IP) address, etc.) associated with player account. For example, the system can transmit the message during an online browsing session via an online session identifier associated with the player to whom the player account is assigned. For instance, the system can transmit the message to a webpage associated with an IP address for a computing device that the player uses to login to a player account. The message can include a notification of the deposit as well as an indication of what the reward was that was assigned to the player account based on the deposit. The system can also present controls for a player to select the type or value of the reward and/or to compare different possible awards. For example, in FIG. 4, a wagering game system ("system") 400 includes a personal computer 445 and a wagering game server 450 connected to a communications network 422. The system 400 also includes a wagering game machine 460 connected to the wagering game server 450 within a physical wagering venue, such as a casino 405. A player makes one or more deposits in a player account prior to visiting the casino 405, such as via the personal computer 445. The personal computer 445 presents online content 403. A portion 407 of the online content 403 indicates that a balance for the player account has been maintained above a certain amount (e.g., above $500) for a period of time (e.g., three months), and as result, the system 400 provides rewards. One of the rewards is an online reward of ten points that can be redeemed at various locations online, such as at a gaming website called PlayersLife.Com. Another reward is a casino reward. However, the casino reward may be one of many different rewards that a player can select from, such as via selection of an object (e.g., a link) within the portion 407 of the online content 403. When the link is selected, the system 400 can present various rewards offered by different casinos. A player can compare the offers and select from the various offers.

Returning again to FIG. 3, in some embodiments, the system can generate messages to remind the player of the reward. For example, the system can detect when a mobile device associated with the player account approaches a threshold proximity to a casino. The system can then transmit a message to the mobile device that indicates that the player account has the funds and that the funds can be utilized at the casino. The message can include a map to the casino as well as other offers associated with visiting the casino.

The flow 300 continues at processing block 314, where the system redeems the reward. For example, after the reward has been assigned to the player account, the system can redeem the reward in response to player input made by the player. The player can initiate the input from a computing device external to the casino or via a machine in the casino (e.g. a wagering game machine). Within a casino, the system can provide options to use some or all of the reward at any time. The reward can go directly into play for a game (e.g., the reward is associated with a random number generation associated with a wagering game). In some embodiments, using a reward in a casino (e.g., via game play in a wagering game) can result in offers of additional rewards, such as points used for non-wagering, online games and rewards that can be used later online.

In some embodiments, the winnings earned within a casino can go into a second player account, or sub-portion of the player account. The system can shield, or lock, use of the funds during a time period (e.g., for a day) or until future game play at a different time period (e.g., for use on a different date). For example, returning to the description of FIG. 4, the system can present the online content 403, via the personal computer 445, prior to the player visiting the casino 405. A portion 409 of the online content 403 indicates a table 411 that specifies specific percentages of wagering game earnings to automatically set aside at a next visit to the casino 405. A first row 413 indicates that if a player specifies to set aside 10% of winnings, then the system 400 will offer a matching reward equivalent to one ("1") times the set-aside amount in online venue points that are redeemable online, such as the online gaming venue (e.g., PlayersLife.Com). The system 400 can also offer a reward associated with a third party that would match the set-aside amount in points that can be redeemed via online venues (or other venues) associated with the third party. A second row 415 specifies that a set-aside percentage of 20% results in a times-two factor in matching online venue points and a times-one factor for third-party points. A third row 417 specifies that a set-aside percentage of 30% results in a times-four factor in matching online venue points and a times-two factor for third-party points. As can be seen, a higher increase in the set-aside amount results in incrementally increasing rewards. Subsequently, when the player visits the casino 405 and logs in to the wagering game machine 460 via the player account, the system 400 initiates a wagering game session. During the wagering game session, a player may win gaming credits, such as via random winning configurations that occur on reels 402 associated with wagering game content 404. The system 400 can then present a message 410 notifying the player of the win amount (e.g., 10 credits) and that a percentage of the win amount (e.g., 30%, or 3 credits) is being automatically set aside into a second player account that can only be accessed during a subsequent visit to the casino 405. Further, the system 400 indicates, via the message 410, that additional rewards will be awarded. For instance, the system 400 indicates that a reward is provided of an amount of points (e.g., 12 points) equivalent to the set aside amount multiplied by the multiplier (e.g., 4×3 credits=12 points), and will be associated with the player account for used at online venues and/or for use with third-party venues.

Additional Example Operating Environments

This section describes additional example operating environments, systems, networks, etc. and presents structural aspects of some embodiments.

Wagering Game Computer System

Figure 5:
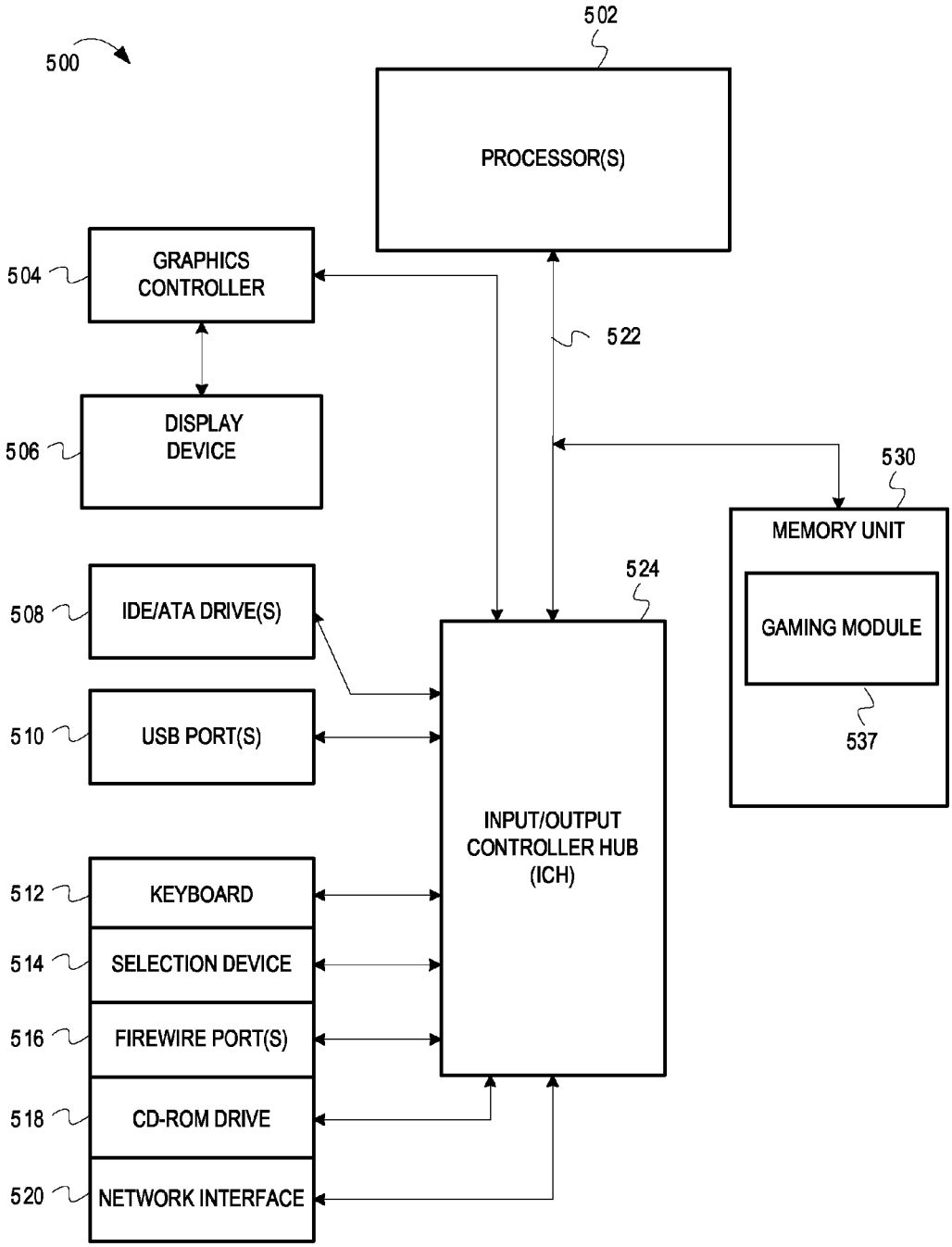
FIG. 5 is an illustration of a wagering game computer system 500, according to some embodiments.

FIG. 5 is a conceptual diagram that illustrates an example of a wagering game computer system 500, according to some embodiments. In FIG. 5, the wagering game computer system ("computer system") 500 may include a processor unit 502, a memory unit 530, a processor bus 522, and an Input/Output controller hub (ICH) 524. The processor unit 502, memory unit 530, and ICH 524 may be coupled to the processor bus 522. The processor unit 502 may comprise any suitable processor architecture. The computer system 500 may comprise one, two, three, or more processors, any of which may execute a set of instructions in accordance with some embodiments.

The memory unit 530 may also include an I/O scheduling policy unit and I/O schedulers. The memory unit 530 can store data and/or instructions, and may comprise any suitable memory, such as a dynamic random access memory (DRAM), for example. The computer system 500 may also include one or more suitable integrated drive electronics (IDE) drive(s) 508 and/or other suitable storage devices. A graphics controller 504 controls the display of information on a display device 506, according to some embodiments.

The ICH 524 provides an interface to I/O devices or peripheral components for the computer system 500. The ICH 524 may comprise any suitable interface controller to provide for any suitable communication link to the processor unit 502, memory unit 530 and/or to any suitable device or component in communication with the ICH 524. The ICH 524 can provide suitable arbitration and buffering for each interface.

For one embodiment, the ICH 524 provides an interface to the one or more IDE drives 508, such as a hard disk drive (HDD) or compact disc read only memory (CD ROM) drive, or to suitable universal serial bus (USB) devices through one or more USB ports 510. For one embodiment, the ICH 524 also provides an interface to a keyboard 512, selection device 514 (e.g., a mouse, trackball, touchpad, etc.), CD-ROM drive 518, and one or more suitable devices through one or more firewire ports 516. For one embodiment, the ICH 524 also provides a network interface 520 though which the computer system 500 can communicate with other computers and/or devices.

The computer system 500 may also include a machine-readable storage medium that stores a set of instructions (e.g., software) embodying any one, or all, of the methodologies to fund, reward, and control usage of wagering game player accounts. Furthermore, software can reside, completely or at least partially, within the memory unit 530 and/or within the processor unit 502. The computer system 500 can also include a gaming module 537. The gaming module 537 can process communications, commands, or other information, to fund, reward, and control usage of wagering game player accounts. Any component of the computer system 500 can be implemented as hardware, firmware, and/or machine-readable storage media including instructions for performing the operations described herein.

Personal Wagering Game System

Figure 6:
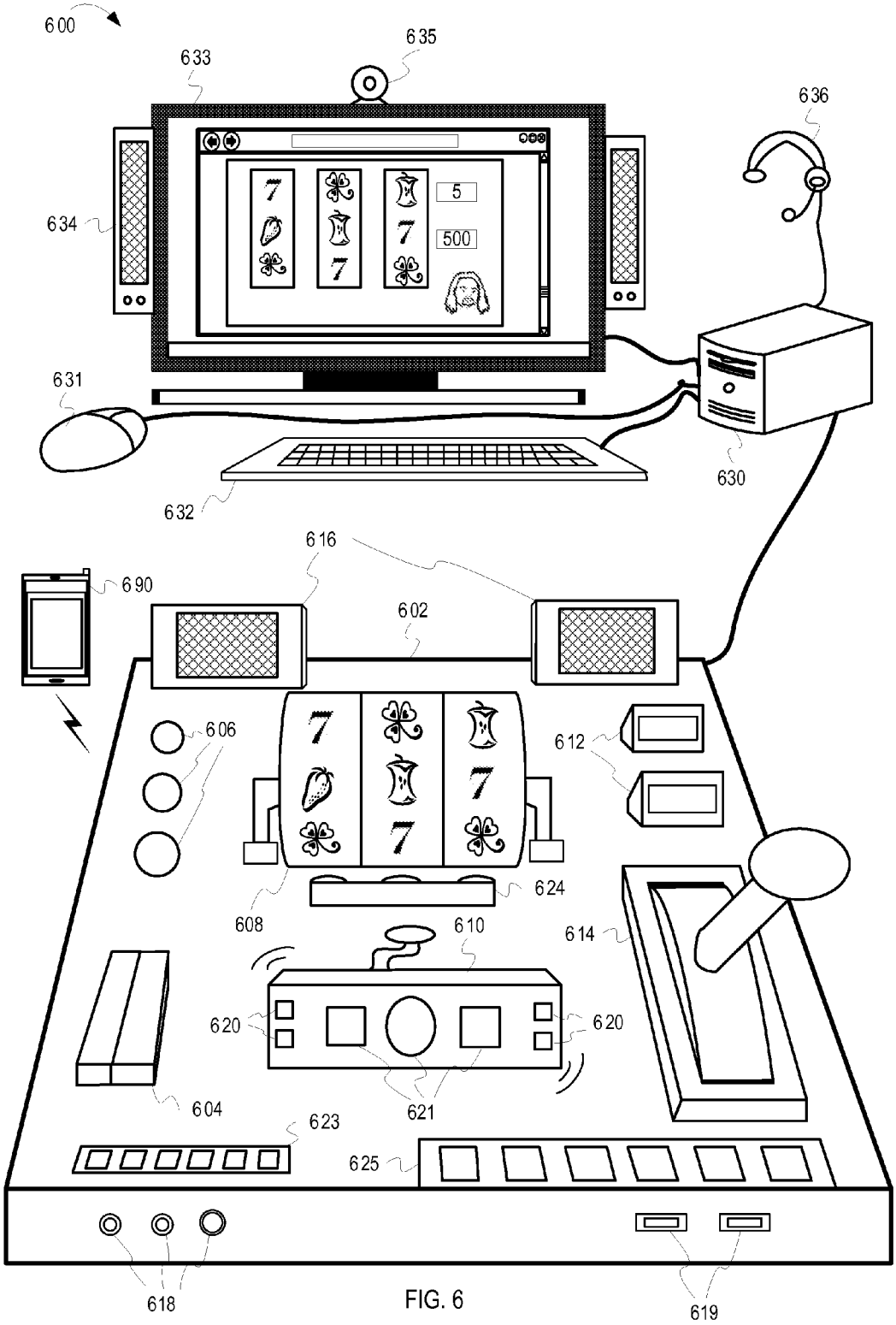
FIG. 6 is an illustration of a personal wagering game system 600, according to some embodiments.

FIG. 6 is a conceptual diagram that illustrates an example of a personal wagering game system 600, according to some embodiments. In FIG. 6, the personal wagering game system ("system") 600 includes an exemplary computer system 630 connected to several devices, including user input devices (e.g., a keyboard 632, a mouse 631), a web-cam 635, a monitor 633, speakers 634, and a headset 636 that includes a microphone and a listening device. In some embodiments, the webcam 635 can detect fine details of a person's facial features, from an eye-level perspective. The web-cam 635 can use the fine detail to determine a person's identity, their demeanor, their facial expressions, their mood, their activities, their eye focus, etc. The headset 636 can include biometric sensors configured to detect voice patterns, spoken languages, spoken commands, etc. The biometric sensors in the web-cam 635 can detect colors (e.g., skin colors, eye colors, hair colors, clothing colors, etc.) and textures (e.g., clothing material, scars, etc.). The biometric sensors in the web-cam 635 can also measure distances between facial features (e.g., distance between eyes, distance from eyes to nose, distance from nose to lips, length of lips, etc.). The system 600 can generate a facial and body map using the detected colors, textures, and facial measurements. The system 600 can use the facial and body map to generate similar facial features and body appearances for a player account avatar. Also connected to the computer system 630 is a gaming control device ("gaming pad") 602 including wagering game accoutrements associated with wagering games. The wagering game accoutrements include one or more of reels 608, game meters 612, indicators 606, a game control device 610, a physical lever 614, a magnetic card reader 604, a video projection device 624, input/output ports 618, USB ports 619, and speakers 616. The gaming pad 602 can present feedback of online activities. For instance, the gaming pad 602 can use vibrations and signals on the gaming control device (e.g., the game control device 610 or the physical lever 614 can vibrate to indicate a back pat from another player or a game celebration, the indicators 606 can blink, etc.). The physical lever 614 can produce feelings in the lever to emulate a pulling feel or a vibration. The video projection device 624 can project video onto the reels 608 so that the reels 608 can present many different types of wagering games. The reels 608 can spin when the physical lever 614 is pulled. The video projection device 624 can project reel icons onto the reels 608 as they spin. The video projection device 624 can also project reel icons onto the reels 608 when the reels 608 are stationary, but the imagery from the video project device 624 makes the reels 608 appear to spin. The magnetic card reader 604 can be used to swipe a credit card, a player card, or other cards, so that the system can quickly get information. The system 600 can offer lower rates for using the magnetic card reader 604 (e.g., to get a lower rate per transaction). The game control device 610 can include an emotion indicator keypad with keys 620 that a player can use to indicate emotions. The game control device 610 can also include biometric devices 621 such as a heart-rate monitor, an eye pupil dilation detector, a fingerprint scanner, a retinal scanner, voice detectors, speech recognition microphones, motion sensors, sound detectors, etc. The biometric devices 621 can be located in other places, such as in the headset 636, within a chair (not shown), within personal control devices (e.g. joysticks, remote controls, game pads, roller-balls, touch-pads, touch-screens, etc.), within the web-cam 635, or any other external device. The external devices can be connected to the computer 630 or to the game control device 610 via the input/output ports 618. In some embodiments, the game pad 602 communicates with a mobile client 690. As a security feature, some biometric devices can be associated with some of the gaming pad devices (e.g., the magnetic card reader 604), such as a fingerprint scanner, a retinal scanner, a signature pad to recognize a player's signature, etc. The game control device 610 can also use the keys 620 to share items and control avatars, icons, game activity, movement, etc. within a network wagering venue. The game pad can also have an electronic (e.g., digital) button panel 625, an electronic control panel 623, or any other type of changeable panel that can change appearance and/or configuration based on the game being played, the action being performed, and/or other activity presented within an online gaming venue. The game control device 610 can also move in different directions to control activity within the online gaming venue (e.g., movement of a player's avatar moves in response to the movements of the game control device 610). Avatars can be pre-programmed to act and look in certain ways, which the player can control using the system 600. The gaming pad 602 can permit the player to move the avatar fluidly and more easily than is possible using a standard keyboard. The system 600 can cause an avatar to respond to input that a player receives via the gaming pad 602. For example, a player may hear a sound that comes primarily from one direction (e.g., via stereophonic signals in the headset 636) within the network wagering venue. The system 600 can detect the movement of the player (e.g., the system 600 detects that a player moves his head to look in the direction of the sound, the player uses the game control device 610 to move the avatar's perspective to the direction of the sound, etc.). The system 600 can consequently move the avatar's head and/or the avatar's perspective in response to the player's movement. The player can indicate an expression of an emotion indicated by the player using the keys 620. The system 600 can make the avatar's appearance change to reflect the indicated emotion. The system 600 can respond to other movements or actions by the player and fluidly move the avatar to respond. The system 600 can also interpret data provided by the biometric devices and determine expressions and/or indications of emotions for a player using the system 600.

Wagering Game Machine Architecture

Figure 7:
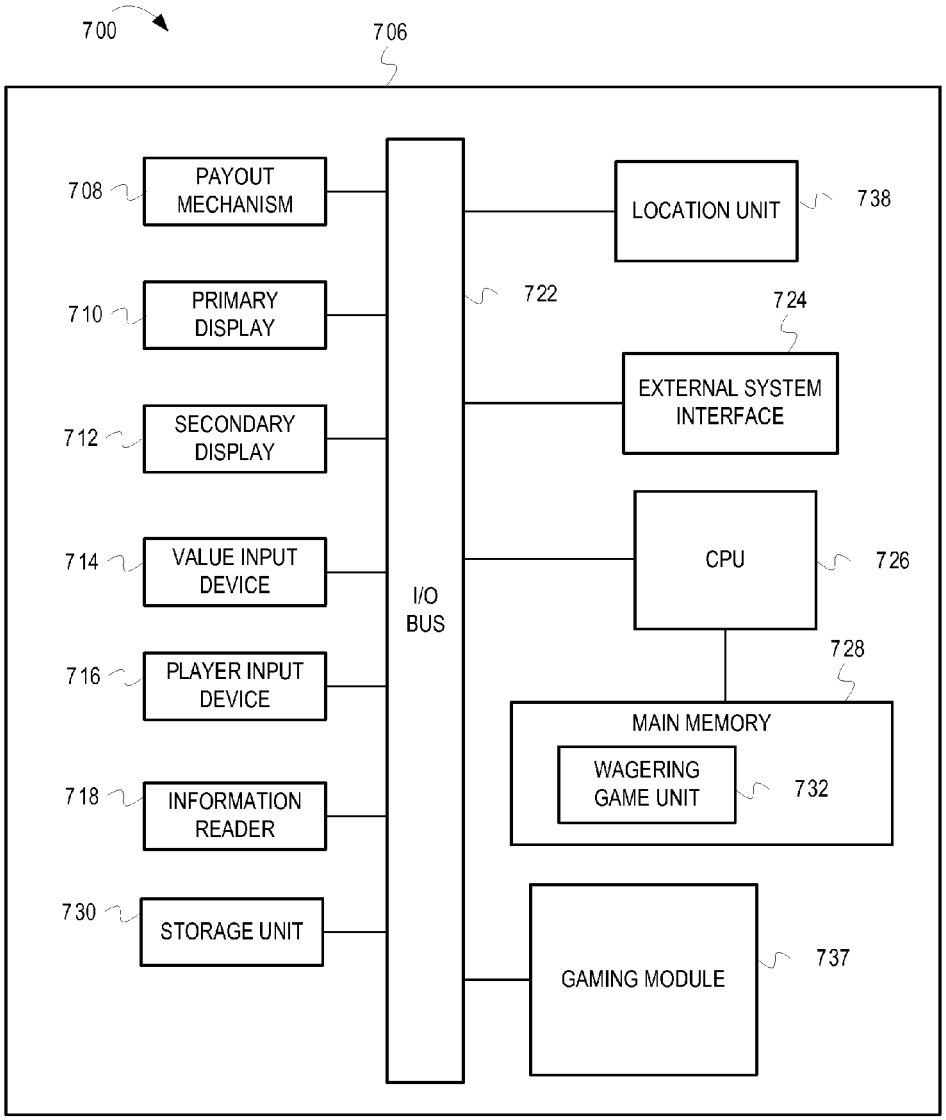
FIG. 7 is an illustration of a wagering game machine architecture 700, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video black jack, video slots, video lottery, reel slots, etc., in whole or part.

The CPU 726 is also connected to an input/output ("I/O") bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites. In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes a gaming module 737. The gaming module 737 can process communications, commands, or other information, where the processing can fund, reward, and control usage of wagering game player accounts.

Furthermore, any component of the wagering game machine 706 can include hardware, firmware, and/or machine-readable storage media including instructions for performing the operations described herein.

Wagering Game Machine

Figure 8:
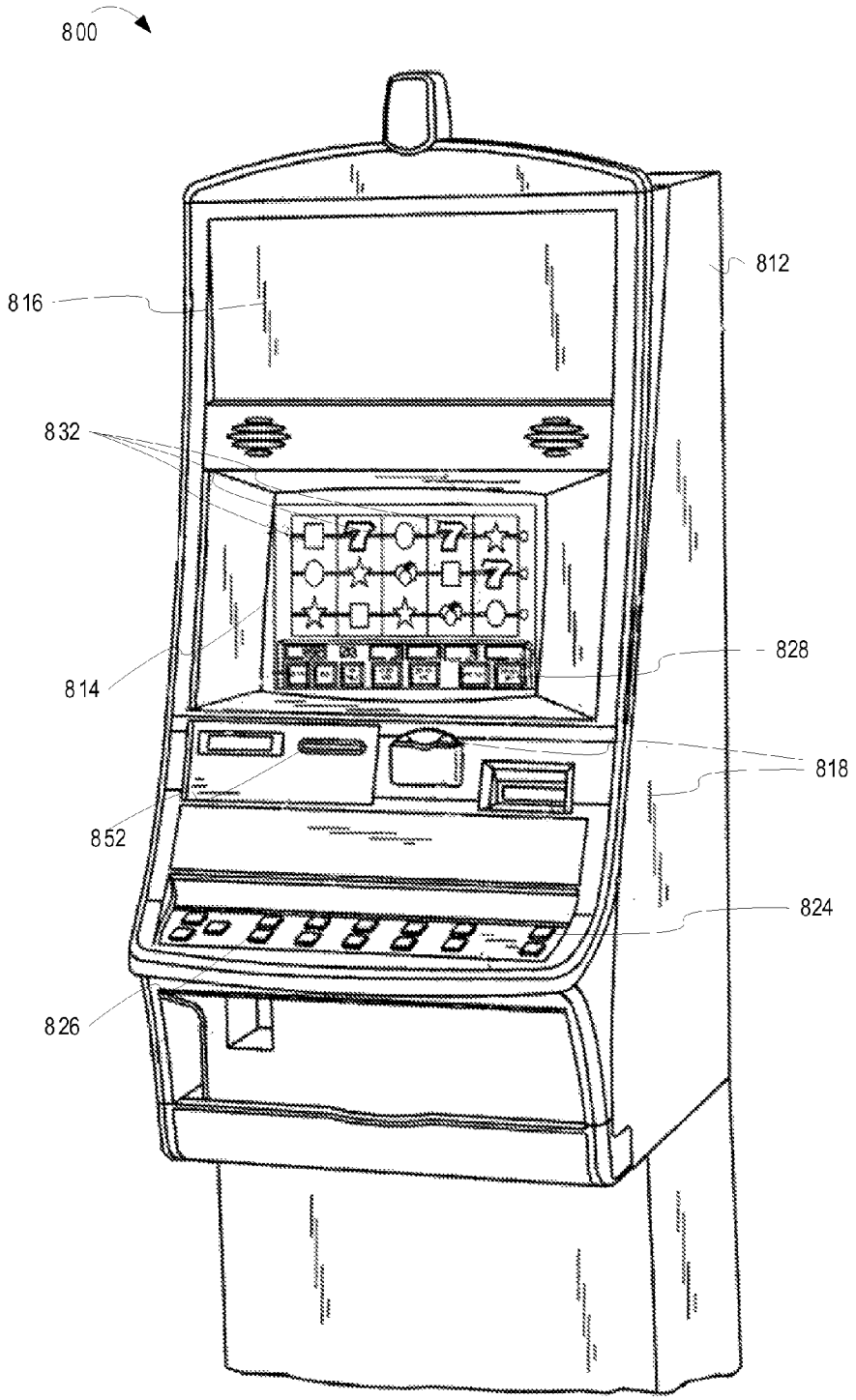
FIG. 8 is an illustration of a wagering game machine 800, according to some embodiments.

FIG. 8 is a conceptual diagram that illustrates an example of a wagering game machine 800, according to some embodiments. Referring to FIG. 8, the wagering game machine 800 can be used in gaming establishments, such as casinos. According to some embodiments, the wagering game machine 800 can be any type of wagering game machine and can have varying structures and methods of operation. For example, the wagering game machine 800 can be an electromechanical wagering game machine configured to play mechanical slots, or it can be an electronic wagering game machine configured to play video casino games, such as blackjack, slots, keno, poker, blackjack, roulette, etc.

The wagering game machine 800 comprises a housing 812 and includes input devices, including value input devices 818 and a player input device 824. For output, the wagering game machine 800 includes a primary display 814 for displaying information about a basic wagering game. The primary display 814 can also display information about a bonus wagering game and a progressive wagering game. The wagering game machine 800 also includes a secondary display 816 for displaying wagering game events, wagering game outcomes, and/or signage information. While some components of the wagering game machine 800 are described herein, numerous other elements can exist and can be used in any number or combination to create varying forms of the wagering game machine 800.

The value input devices 818 can take any suitable form and can be located on the front of the housing 812. The value input devices 818 can receive currency and/or credits inserted by a player. The value input devices 818 can include coin acceptors for receiving coin currency and bill acceptors for receiving paper currency. Furthermore, the value input devices 818 can include ticket readers or barcode scanners for reading information stored on vouchers, cards, or other tangible portable storage devices. The vouchers or cards can authorize access to central accounts, which can transfer money to the wagering game machine 800.

The player input device 824 comprises a plurality of push buttons on a button panel 826 for operating the wagering game machine 800. In addition, or alternatively, the player input device 824 can comprise a touch screen 828 mounted over the primary display 814 and/or secondary display 816.

The various components of the wagering game machine 800 can be connected directly to, or contained within, the housing 812. Alternatively, some of the wagering game machine's components can be located outside of the housing 812, while being communicatively coupled with the wagering game machine 800 using any suitable wired or wireless communication technology.

The operation of the basic wagering game can be displayed to the player on the primary display 814. The primary display 814 can also display a bonus game associated with the basic wagering game. The primary display 814 can include a cathode ray tube (CRT), a high resolution liquid crystal display (LCD), a plasma display, light emitting diodes (LEDs), a three-dimensional (3D) display, or any other type of display suitable for use in the wagering game machine 800. Alternatively, the primary display 814 can include a number of mechanical reels to display the outcome. In FIG. 8, the wagering game machine 800 is an "upright" version in which the primary display 814 is oriented vertically relative to the player. Alternatively, the wagering game machine can be a "slant-top" version in which the primary display 814 is slanted at about a thirty-degree angle toward the player of the wagering game machine 800. In yet another embodiment, the wagering game machine 800 can exhibit any suitable form factor, such as a free standing model, bar top model, mobile handheld model, or workstation console model.

A player begins playing a basic wagering game by making a wager via the value input device 818. The player can initiate play by using the player input device's buttons or touch screen 828. The basic game can include arranging a plurality of symbols 832 along a pay line, which indicates one or more outcomes of the basic game. Such outcomes can be randomly selected in response to player input. At least one of the outcomes, which can include any variation or combination of symbols, can trigger a bonus game.

In some embodiments, the wagering game machine 800 can also include an information reader 852, which can include a card reader, ticket reader, bar code scanner, RFID transceiver, or computer readable storage medium interface. In some embodiments, the information reader 852 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a gaming system, said method comprising:

determining, via a position tracking device of a computing device, that the computing device is located outside of a physical gaming venue, wherein the computing device is associated with a wagering game player account;

electronically transmitting, by a communications network interface of the gaming system to the computing device via a communications network, an offer of a reward to deposit funds into the wagering game player account in response to the determining that the computing device is located outside of the physical gaming venue, wherein the wagering game player account is configured for use with one or more wagering game machines associated with the physical gaming venue;

detecting, by the communications network interface, a notification sent by the computing device via the communications network, wherein the notification indicates a player input associated with the offer, wherein the player input is made via the computing device, and wherein the notification authorizes an electronic transfer of the funds from a financial account for deposit into the wagering game player account;

electronically transferring, via the communications network, the funds from the financial account to the wagering game player account in response to the detecting the notification;

assigning, via a gaming module of the gaming system, the reward to the wagering game player account in response to the electronically transferring the funds; and assigning, via the gaming module, a value for the reward based on one or more of a time value associated with an account balance associated with the wagering game player account separate from the offer, a performance value associated with an activity performed via an online browsing session separate from the player input, a purchase value associated with a purchase made prior to presenting the offer, and an affiliation value associated with an affiliation with a third party.

2. The method of claim 1 further comprising:

transmitting a message that offers the reward, wherein the message is configured for receipt via the computing device, and wherein the message includes an object configured for automated response to the offer via the player input; and detecting a selection of the object, via the player input, wherein the selection of the object authorizes the electronic transfer of the funds.

3. The method of claim 1, wherein the player input specifies an amount of the funds and includes authorization information to connect the financial account to the wagering game player account via an online browsing session.

4. The method of claim 1, wherein the reward provides access to online game content via an online wagering venue, and further comprising:

determining progress made via game play of the online game content initiated via redemption of the reward; and assigning an additional reward with the wagering game player account, wherein the additional reward is redeemable within a wagering game session conducted via at least one of the one or more wagering game machines located within the physical gaming venue.

5. The method of claim 1 further comprising:

presenting an indication of an activity required to be performed before the reward can be made accessible;

detecting performance of the activity in association with the wagering game player account; and authorizing access to the reward in response to detecting the performance of the activity.

6. One or more non-transitory, machine-readable storage media having instructions stored thereon, which when executed by a set of one or more processors of a gaming system causes the set of one or more processors to perform operations comprising:

determining, via a position tracking device of a computing device, that a wagering game player account is used by the computing device when the computing device is located outside of a physical gaming venue;

electronically transmitting, by a communications network interface of the gaming system to the computing device via a communications network, an offer of a reward to deposit funds into the wagering game player account in response to the determining that the wagering game player account is used by the computing device when outside the physical gaming venue, wherein the wagering game player account is configured for use with one or more wagering game machines associated with the physical gaming venue;

detecting, by the communications network interface, a notification sent by the computing device via the communications network that indicates a player input associated with the offer, wherein the player input is made via the computing device, and wherein the notification authorizes an electronic transfer of the funds from a financial account for deposit into the wagering game player account;

electronically transferring, via the communications network, the funds from the financial account to the wagering game player account in response to the notification;

assigning, via a gaming module of the gaming system, the reward to the wagering game player account in response to the electronically transferring the funds;

assigning, via the gaming module, a value for the reward based on a condition associated with the wagering game player account;

determining, via the gaming module, progress made via game play of online game content initiated via redemption of the reward; and assigning, via the gaming module, an additional reward with the wagering game player account, wherein the additional reward is redeemable within a wagering game session conducted via a wagering game machine located within the physical gaming venue.

7. The one or more non-transitory, machine-readable storage media of claim 6, said operations further comprising:

transmitting a message that offers the reward, wherein the message is configured for receipt via the computing device outside a boundary of the physical gaming venue, and wherein the message includes an object configured for response to the offer via the player input; and detecting a selection of the object, via the player input, wherein the selection of the object authorizes the electronic transfer of the funds.

8. The one or more non-transitory, machine-readable storage media of claim 6, wherein the condition associated with the wagering game player account comprises one or more of a time value associated with an account balance of the wagering game player account, a performance value associated with an activity performed via an Internet browsing session associated with the wagering game player account, a purchase value associated with a purchase made prior to presenting the offer via a credit card associated with the wagering game player account, and an affiliation value associated with an affiliation with a third-party indicated via the wagering game player account.

9. The one or more non-transitory, machine-readable storage media of claim 6, wherein the player input specifies an amount of the funds and includes authorization information to connect the financial account to the wagering game player account via an Internet browsing session.

10. The one or more non-transitory, machine-readable storage media of claim 6, said operations further comprising:

providing a notification of the award in response to the assigning of the award to the wagering game player account; and redeeming the award in response to additional player input.

11. A gaming system comprising:

one or more processors;

a communications network interface for communications via a communications network; and a memory storage device configured to store instructions, which when executed by the one or more processors, cause the gaming system to determine, via a position tracking device of a computing device, that the computing device is located outside of a physical gaming venue, wherein the computing device is associated with a wagering game player account;

electronically transmit, by the communications network interface to the computing device via the communications network, an offer of a reward to deposit funds into the wagering game player account prior to initiating a wagering game session via one or more wagering game machines in the physical gaming venue in response to determination that the computing device is located outside the physical gaming venue, wherein the computing device is other than the one or more wagering game machines, detect, by the communications network interface, a notification sent by the computing device via the communications network, wherein the notification indicates a player input associated with the offer, wherein the player input is made via the computing device, and wherein the player input authorizes an electronic transfer of the funds from a financial account for deposit into the wagering game player account, electronically transfer the funds from the financial account to the wagering game player account in response to the notification, assign the reward to the wagering game player account in response to the electronic transfer of the funds, detect redemption of the reward via additional player input via a webpage interface presented via the computing device prior to the initiation of the wagering game session, wherein the computing device is configured to receive and present the offer via the webpage interface associated with a display of the computing device, and wherein the computing device is configured to receive the additional player input via the webpage interface and transmit the additional player input, detect a condition associated with redemption of the reward, and generate an additional reward that is redeemable in the casino based on the condition associated with redemption of the reward.

12. The gaming system of claim 11 further comprising an account server configured to store the wagering game player account, store an indication of the reward in the wagering game player account, and store one or more characteristics associated with the reward; and a wagering game machine configured to present wagering game content during the wagering game session subsequent to assignment of the award to the wagering game player account, access the wagering game player account stored on the account server, determine a value for the reward based on one or more characteristics stored in the wagering game player account, and redeem the value of reward for the wagering game content during the wagering game session.

13. The gaming system of claim 11 further comprising:

a financial account server configured to receive account access information associated with the financial account from a gaming server associated with the wagering game module in response to the player input, and authorize the electronic transfer of the funds from the financial account to the wagering game player account using the account access information.

14. The gaming system of claim 11 further comprising:

a third party server configured to detect a request to redeem the reward, and provide the reward in response to the request to redeem the reward.

15. The gaming system of claim 11, wherein the memory storage device is further configured to store instructions, which when executed by the one or more processors, cause the gaming system to, present a non-wagering game via a website prior to initiation of the wagering game session, detect an achievement attained via play of the non-wagering game, and assign a characteristic to the reward that provides a benefit in a wagering game that is related to the achievement attained in the non-wagering game.

16. A gaming apparatus comprising:

one or more processors;

a communications network interface configured for communications via communications network; and a gaming module configured to, via the one or more processors, determine, via a position tracking device of a computing device, that a wagering game player account is used by the computing device when the computing device is located outside of a casino, electronically transmit, by the communications network interface to the computing device via the communications network, a message that offers a reward to deposit funds into the wagering game player account before initiating a wagering game session within the casino in response to determination that the wagering game player account is used by the computing device when the computing device is located outside of the casino, wherein the message includes an object configured for response to the offer via selection, detect, by the communications network interface, a selection of the object within the message via a first user input via the computing device, wherein the selection of the object authorizes an automated electronic transfer of the funds from a financial account for deposit into the wagering game player account, assign the reward to the wagering game player account in response to the detection of the selection of the object, detect use of the reward via the wagering game session in response to a second user input via one or more input devices of one or more wagering game machines located within the casino, determine an amount of money won via the use of the reward, automatically select a portion of the amount of money, and restrict use of the portion of the amount of money via the wagering game player account until a subsequent time.

17. The gaming apparatus of claim 16, wherein the gaming module is further configured to:

assign a value for the reward based on one or more of the first user input, additional user input associated with activity during an online browsing session, an amount of funds deposited, an amount of time that a balance in the wagering game player account remains above a specific level, a degree of cyclical deposits into the wagering game player account, an amount of money associated with an online purchase, and a degree of recruitment efforts for additional deposits by social contacts associated with the wagering game player account.

18. The gaming apparatus of claim 16 wherein the gaming module is further configured to determine progress made via game play of online game content initiated via redemption of the reward, and assign an additional reward with the wagering game player account, wherein the additional reward is redeemable within a wagering game session conducted via a wagering game machine located within the casino.

19. The gaming apparatus of claim 16, wherein the reward comprises one or more of non-monetary credits to play a non-wagering game, unlocked content, eligibility for a progressive award, a sweepstakes entry, a discount, points, a mobile application, an entry into a community game, access to restricted wagering games, a bonus in a wagering game, an increment to a win value in a wagering game, an increment to an expected payout value for a wagering game, an item available at the casino, a virtual asset that improves performance in a wagering game, an increase in social status points, a customization of one or more of a feature, characters, and theme of wagering game content, and a modification to a configuration of game play elements in wagering game content.

20. A gaming apparatus comprising:

means for determining, that a wagering game player account is used by a computing device when the computing device is not geographically located at a physical gambling venue;

means for transmitting, by a communications network interface of the gaming apparatus via a communications network, a message to the computing device in response to the determining that the wagering game player account is used by the computing device when the computing device is not geographically located at the physical gambling venue, wherein the message offers a reward to electronically deposit funds into the wagering game player account prior to initiation of a wagering game session via one or more wagering game machines accessible at the physical gambling venue, wherein the computing device is other than the one or more wagering game machines;

means for indicating, via the message, an option to select from a listing of a plurality of potential rewards;

means for detecting, by the network communication interface, a communication from the computing device that indicates a selection of the reward from the listing of the plurality of potential rewards;

means for detecting, in response to user input associated with the message via the computing device, a request to authorize an electronic transfer of the funds from a financial account for deposit into the wagering game player account;

means for assigning the reward to the wagering game player account when the computing device is not located at the physical gambling venue in response to detecting the electronic transfer of funds, wherein the reward is redeemable exclusively at the physical gambling venue; and means for adjusting, by an electronic processing unit associated with the gaming system, a value for the reward based on an amount of time, before redemption of the reward at the physical gambling venue via a wagering game machine, that the funds remain in the wagering game player account after being electronically transferred to the wagering game player account, wherein the wagering game machine includes a value input device configured to receive monetary value for placement of wagers on a wagering game.

21. The gaming apparatus of claim 20 further comprising:

means for detecting use of the reward via the wagering game session;

means for determining an amount of money won via the use of the reward;

means for automatically selecting a portion of the amount of money; and means for restricting use of the portion of the amount of money until a subsequent time.

22. The gaming apparatus of claim 20 further comprising:

prior to transmitting the message to the computing device, means for determining use of the wagering game player account to access non-wagering game content via a website.

23. The gaming apparatus of claim 20 further comprising means for determining a value for the reward based on one or more values stored in the wagering game player account prior to redemption of the reward at the physical gambling venue.

24. The gaming apparatus of claim 23, wherein the one or more values stored in the wagering game player account comprise one or more of an amount of the funds deposited in the wagering game player account, the amount of time that the funds remain in the wagering game player account after being electronically transferred to the wagering game player account, and a degree of cyclical deposits into the wagering game player account.

25. The gaming apparatus of claim 23, wherein the one or more values stored in the wagering game player account comprise one or more of an affiliation value associated with an affiliation of the wagering game player account with a third party, a degree of recruitment efforts for additional deposits by social contacts associated with the wagering game player account, and an amount of money associated with an online purchase performed via a website that the wagering game player account is logged into.

26. The gaming apparatus of claim 20, wherein the one or more values stored in the wagering game player account comprise a performance value associated with an activity performed via an online browsing session.

27. The gaming apparatus of claim 20, wherein the reward that is redeemable exclusively at the physical gambling venue comprises one or more of: content which would not be available at the physical gambling venue without the reward; a feature to increase a potential payout in a wagering game provided at the physical gambling venue; a coupon for a service at the physical gambling venue; a coupon for a product at the physical gambling venue; a virtual asset that represents an achievement for a persistent-state game at the physical gambling venue; a feature to improve performance in a wagering game at the physical gambling venue; social status points that can be used only at the physical gambling venue; a feature to modify content in wagering game content at the physical gambling venue; and a hint for a game provided at the physical gambling venue.

28. The gaming apparatus of claim 20, wherein the message is transmitted prior to initiation of a wagering game session via a wagering game machine at the physical gambling venue, and wherein the computing device is other than a wagering game machine.

* * * * *